US007425045B2

(12) United States Patent
Harari et al.

(10) Patent No.: US 7,425,045 B2
(45) Date of Patent: Sep. 16, 2008

(54) SUPPORTING SYSTEM FOR CLOSET DRAWERS

(75) Inventors: Mordechai Harari, Rishon Lezion (IL); Amos Halfon, Sitira (IL)

(73) Assignee: Hardoor Mechanism Productions Ltd, Rishon Lezion (IL)

( * ) Notice: Subject to any disclaimer, the term of this patent is extended or adjusted under 35 U.S.C. 154(b) by 156 days.

(21) Appl. No.: 11/286,290

(22) Filed: Nov. 25, 2005

(65) Prior Publication Data

US 2006/0071132 A1 Apr. 6, 2006

Related U.S. Application Data

(63) Continuation-in-part of application No. PCT/IL2004/00445, filed on May 24, 2004.

(51) Int. Cl.
*A47B 88/00* (2006.01)

(52) U.S. Cl. ..... 312/139.2; 312/330.1

(58) Field of Classification Search ..... 312/139.2, 312/140, 330.1, 304, 265.5, 265.6
See application file for complete search history.

(56) References Cited

U.S. PATENT DOCUMENTS 489,951 A * 1/1893 Hartsock ..... 312/313
1,544,949 A * 7/1925 Smiley ..... 52/29
2,118,213 A * 5/1938 Malott ..... 312/139.2
2,208,237 A * 7/1940 Williams et al. ..... 312/204
2,665,963 A * 1/1954 Wallack ..... 312/235.3
2,752,641 A * 7/1956 Robertson ..... 52/143
3,702,521 A * 11/1972 Peterson ..... 160/19
3,874,753 A * 4/1975 Naito et al. ..... 312/111
4,303,288 A * 12/1981 Aschinger ..... 312/215
5,690,405 A 11/1997 Huber ..... 312/348.2
5,909,936 A 6/1999 Daniels et al. ..... 312/334.1
6,076,907 A 6/2000 Ambrozy ..... 312/317.3
6,152,549 A * 11/2000 Goto et al. ..... 312/223.1
2006/0225210 A1 * 10/2006 Arason et al. ..... 5/159.1

* cited by examiner

*Primary Examiner*—Janet M Wilkens
(74) *Attorney, Agent, or Firm*—Martin Fleit; Paul D. Bianco; Fleit Gibbons Gutman Bongini & Bianco PL

(57) ABSTRACT

The disclosed supporting system is designed for use with any closet system containing a sliding door and bottom row of two or more drawers. The components of this system transfer the weight of the sliding door and of the upper compartments of the closet to the floor. The system comprises of two outer supporting braces attached to the closet's inners side walls, at least one inner brace attached the drawer divider, and a metal profile attached along the front edge of the shelf above the drawers, reaching the closet's sliding doors' rail. The lower part of each brace is situated on the floor and the upper end of an outer brace supports the shelf above the drawer, while the upper end of an inner brace connects to the lower end of the metal profile.

9 Claims, 11 Drawing Sheets

SUPPORTING SYSTEM FOR CLOSET DRAWERS

FIELD OF THE INVENTION

This application is a continuation in part, claiming priority from PCT application no. PCT/IL/04/00445 filed on May 24, 2004 having a priority date of May 27, 2003. This invention relates to the field of drawers and more particularly to a supporting system for the drawers of a closet with sliding doors.

BACKGROUND

Bedroom closets, kitchen cabinets, and other storage units commonly include drawers at the base for storing various items such as shoes, clothes, pots and pans, or cleaning tools and solutions. Often, such drawers are placed beneath other storage compartments that may contain heavy items; the weight of such items may crush breakable or damageable items stored within the drawers unless properly supported.

For example, a bedroom closet containing shoe drawers at the bottom may contain a sliding door concealing its middle and upper compartments. It is a frequent occurrence that the considerable weight of a sliding-door combined with that of the overall structure of the closet above the shoe drawers inflicts damage on the drawers and the shoes within them.

Previous patents have dealt with the subject of offering additional support for drawer and drawer fixings in various ways. U.S. Pat. No. 5,690,405 discloses a fitting or brace for anchoring drawer rails to a rear or side wall. U.S. Pat. No. 6,076,907 describes a brace that may be installed on a drawer to grant support and prevent the drawer from derailing or breaking when heavy items are stored within it. Though both of the fittings described in these patents provide additional support to the drawers, they are designed to deal with the weight of the items placed within the drawers and not with the weight of those above them.

U.S. Pat. No. 5,909,936 describes a closet system containing a plurality of support members. This system is well supported throughout all compartment units and drawers. However, the support members are built in to the system and cannot be installed on any other existing closet system.

The main objective of the present invention is to provide a drawer brace system that will support drawers positioned at the bottom of a storage unit and prevent the weight of the unit and its upper contents from damaging the drawers and the items within them. It is a further objective of the present invention to provide such a brace system that is easy to install and may be used with any existing storage unit that includes drawers positioned in the manner described above.

SUMMARY

A supporting system for the drawers of a closet with sliding doors wherein the supporting parts of the system transfer the weight of the sliding doors and of the upper compartments from the drawers to the floor, said system comprised of at least two outer supporting braces attached to the closet inners side walls wherein lower part of each brace reaches down to the floor and upper end supports the shelf above the drawer, at least one inner brace is attached to the drawer divider and a metal profile attached to the front panel above the drawer. Said profile is attached to the front edge of the shelf above the drawers and is in contact with the door rail, and the lower edge of the profile is in contact with the upper part of the supporting braces.

The inner braces of the said system are comprised of two symmetrically identical halves, each attached to an inner wall on oppositional sides, whereas a front panel offering extra support by holding the halves of the brace together, and providing an aesthetic finish. The system may be built-in into a closet or added as a support to an existing closet.

A method for providing support to a closet internal division by transferring the weight of the upper compartments and the sliding doors from the drawers to the floor, said method is comprised of attaching at least two outer supporting braces to the closet inners side walls wherein lower part of each brace reaches down to the floor and the upper end supports the shelf above the drawer, attaching at least one inner brace to the drawer divider and attaching a metal profile to the front panel above the drawer. Said profile is attached to the front edge of the shelf above the drawers and is in contact with the door rail, and lower edge of the profile is in contact with the upper part of the supporting braces.

The inner braces of the said method are comprised of two symmetrically identical halves, each attached to an inner wall on oppositional sides, and a front panel offering extra support by holding the halves of the brace together, and providing an aesthetic finish.

BRIEF DESCRIPTION OF THE DRAWINGS

These and further features and advantages of the invention will be more clearly understood in the light of the ensuing description of a preferred embodiment thereof, given by way of example only, with reference to the accompanying drawings, wherein—

DETAILED DESCRIPTION OF THE PREFERRED EMBODIMENTS

Figure 9C:
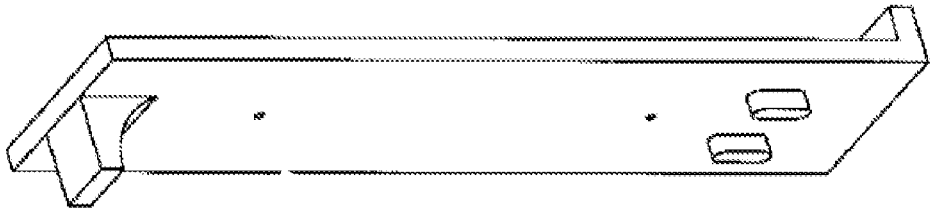
FIG. 9*c* is a perspective view of an outer brace as described in the present invention.
Figure 9B:
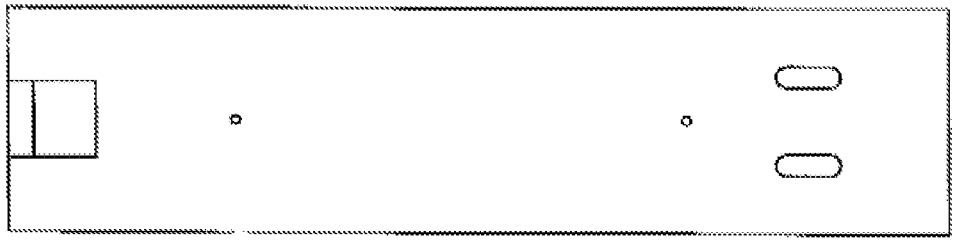
FIG. 9*b* is a front view of an outer brace as described in the present invention.
Figure 9A:
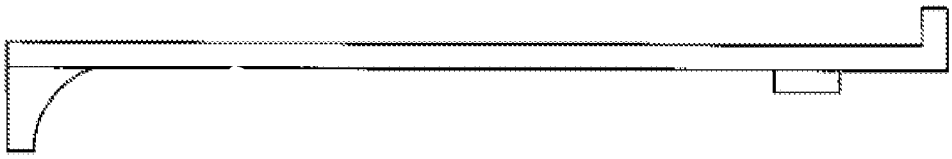
FIG. 9*a* is a side view of an outer brace as described in the present invention.
Figure 10C:
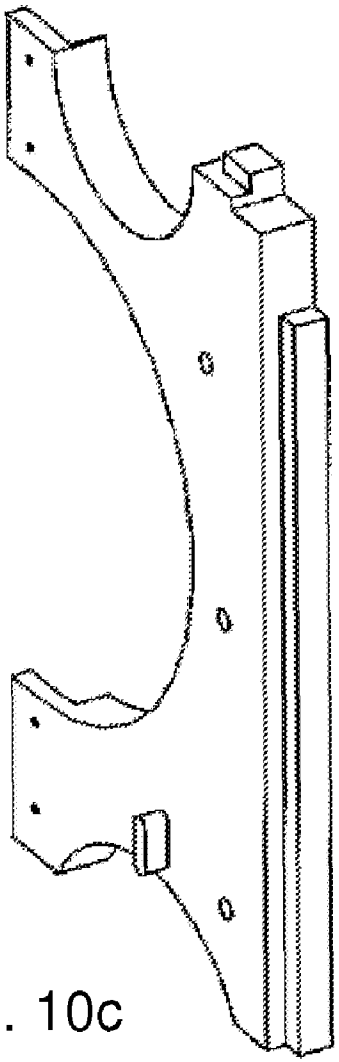
FIG. 10*c* is a perspective view of an inner brace as described in the present invention.
Figure 10B:
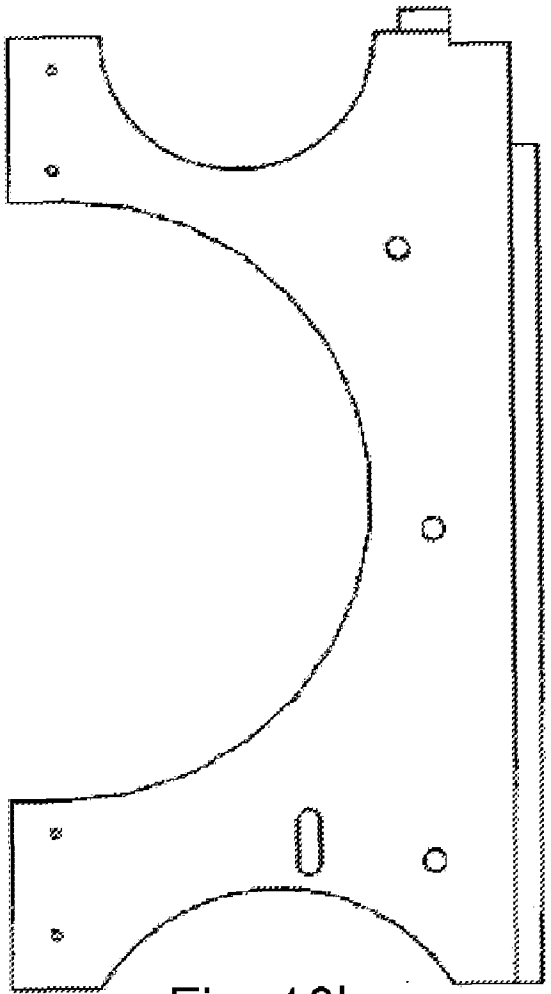
FIG. 10*b* is a front view of an inner brace as described in the present invention.
Figure 10A:
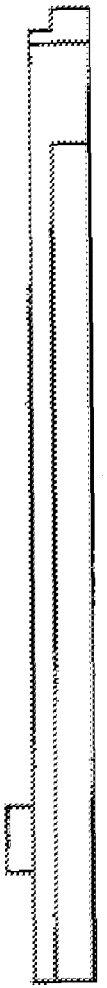
FIG. 10*a* is a side view of an inner brace as described in the present invention.
Figure 11C:
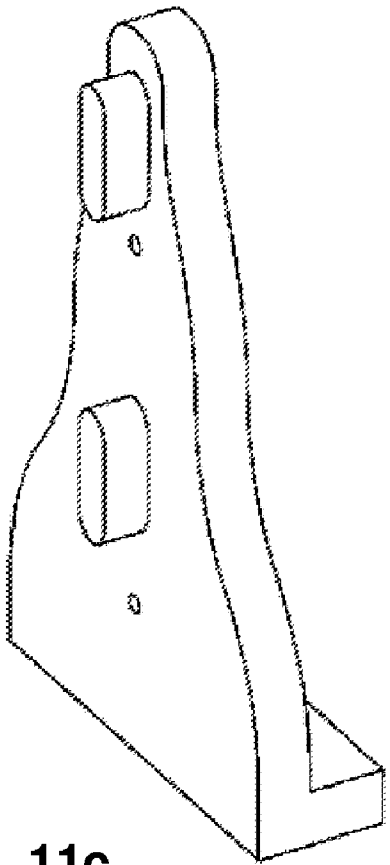
FIG. 11*c* is a perspective view of a rail fitting as described in the present invention.
Figure 11B:
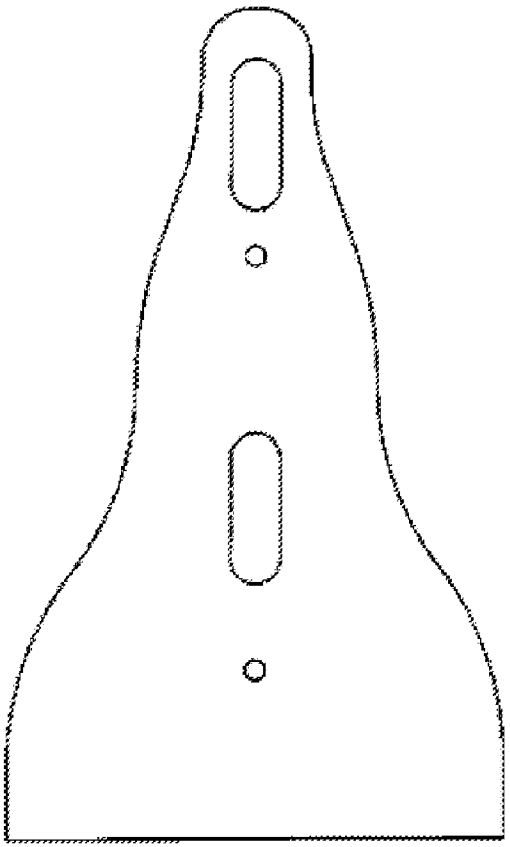
FIG. 11*b* is a front view of a rail fitting as described in the present invention.
Figure 11A:
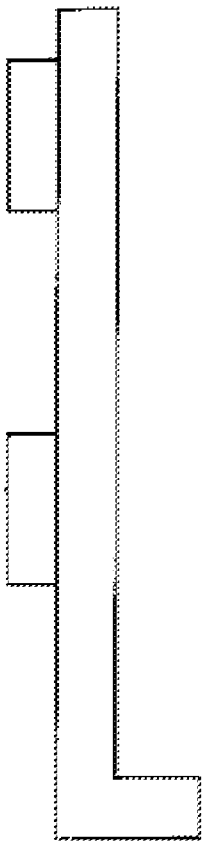
FIG. 11*a* is a side view of a rail fitting as described in the present invention.

The drawer bracing system is designed to be installed on most types of closet systems, and is specially designed for compatibility with a closet system with a bottom row of drawers and a sliding door with further compartments above this row. The system consists of a few main components: a metal profile (FIG. 8), two outer braces (FIG. 9), a plurality of inner braces (FIG. 10) and a plurality of rail fittings (FIG. 11). The number of inner braces and rail fittings correlates to the number of drawers in the closet system.

Figure 1:
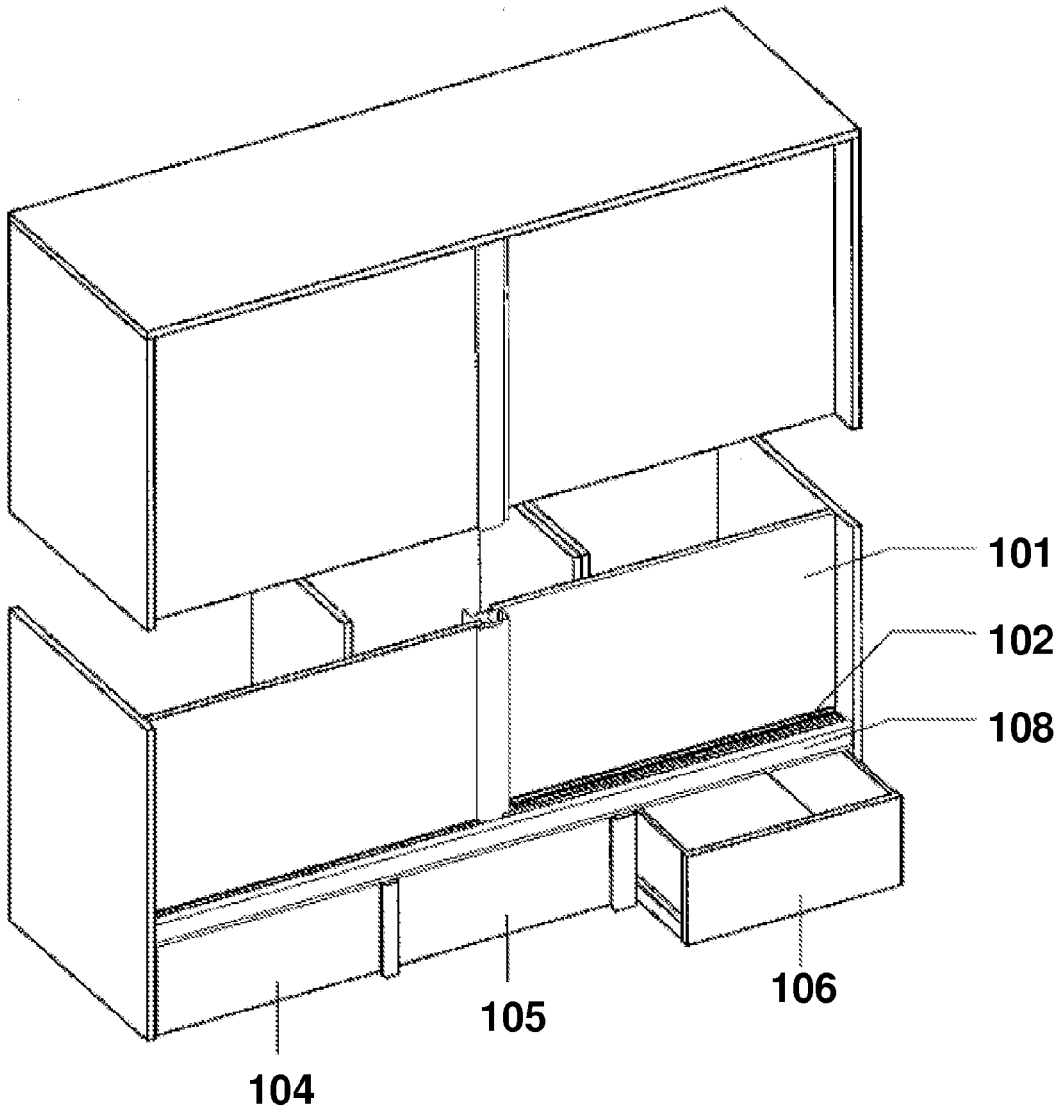
FIG. 1 is a perspective view of a closet equipped with a bracing system constructed and operative in accordance with the present invention.
Figure 2:
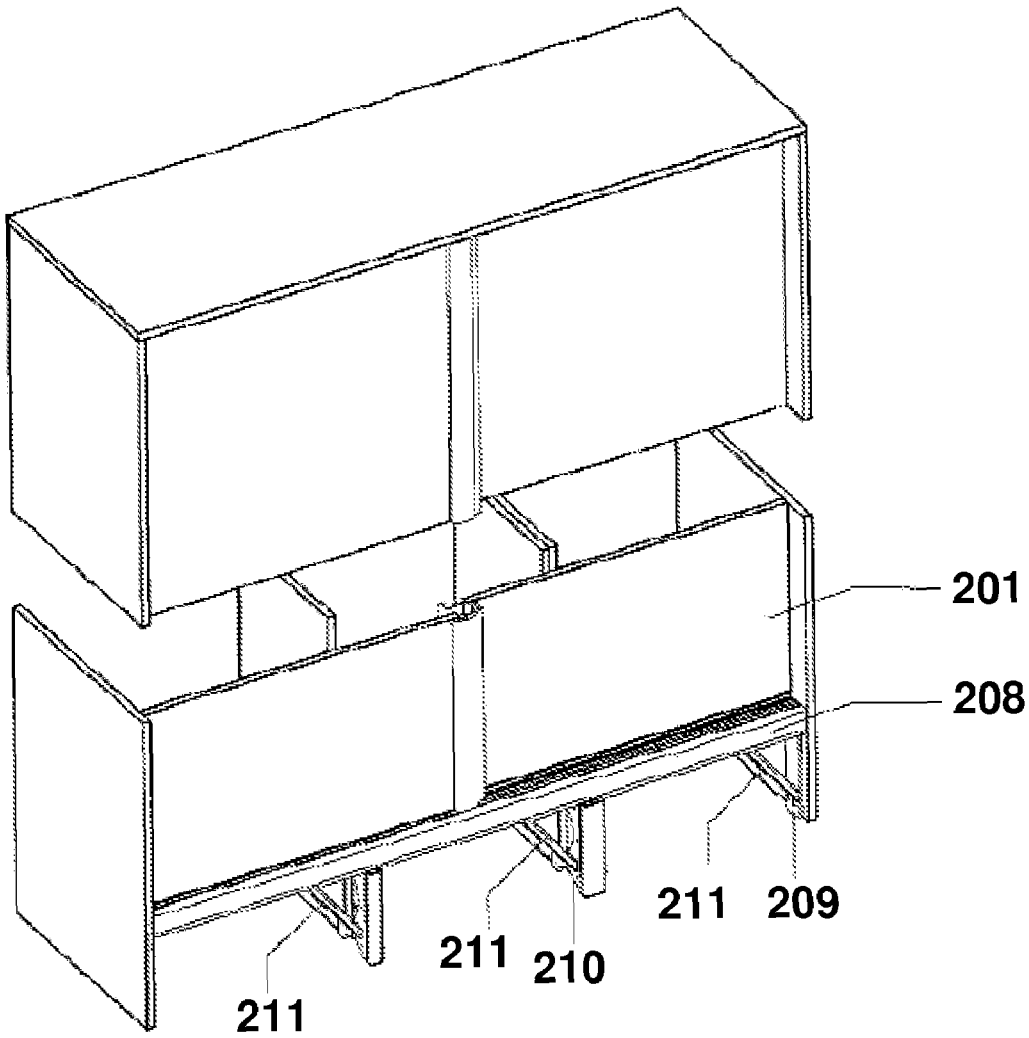
FIG. 2 is a perspective view of a closet equipped with a bracing system, with the drawers removed.
Figure 3:
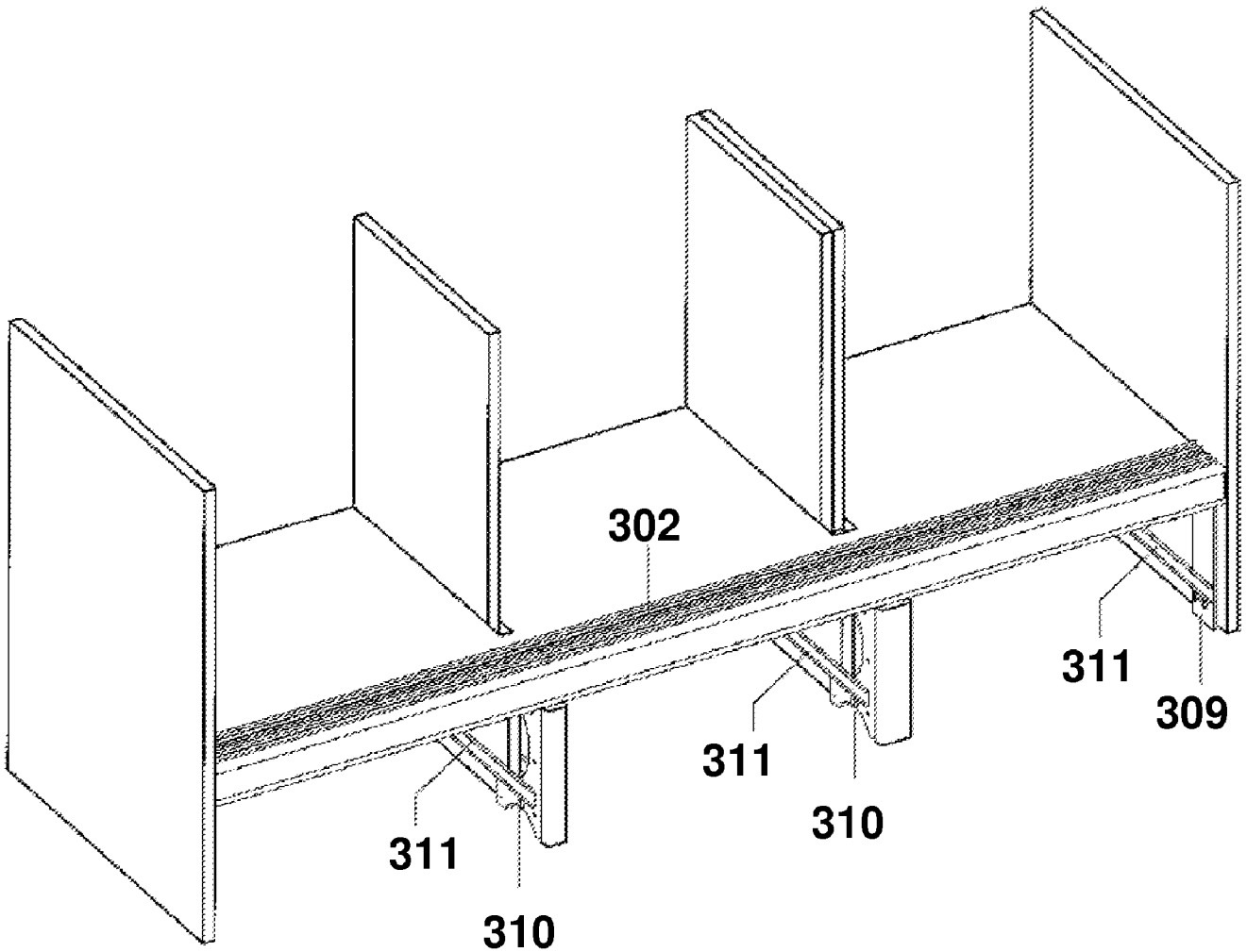
FIG. 3 is a perspective view of the bottom half of a closet equipped with a bracing system, with the drawers and sliding door removed.

In a preferred embodiment of the present invention, which is illustrated in FIG. 1, the bracing system is used with the type of closet described above, containing a sliding door (101) using a sliding door rail (102) and three drawers (104-106) in the bottom row. All references made in this document and the drawings will hereafter be relevant to this embodiment.

Figure 5:
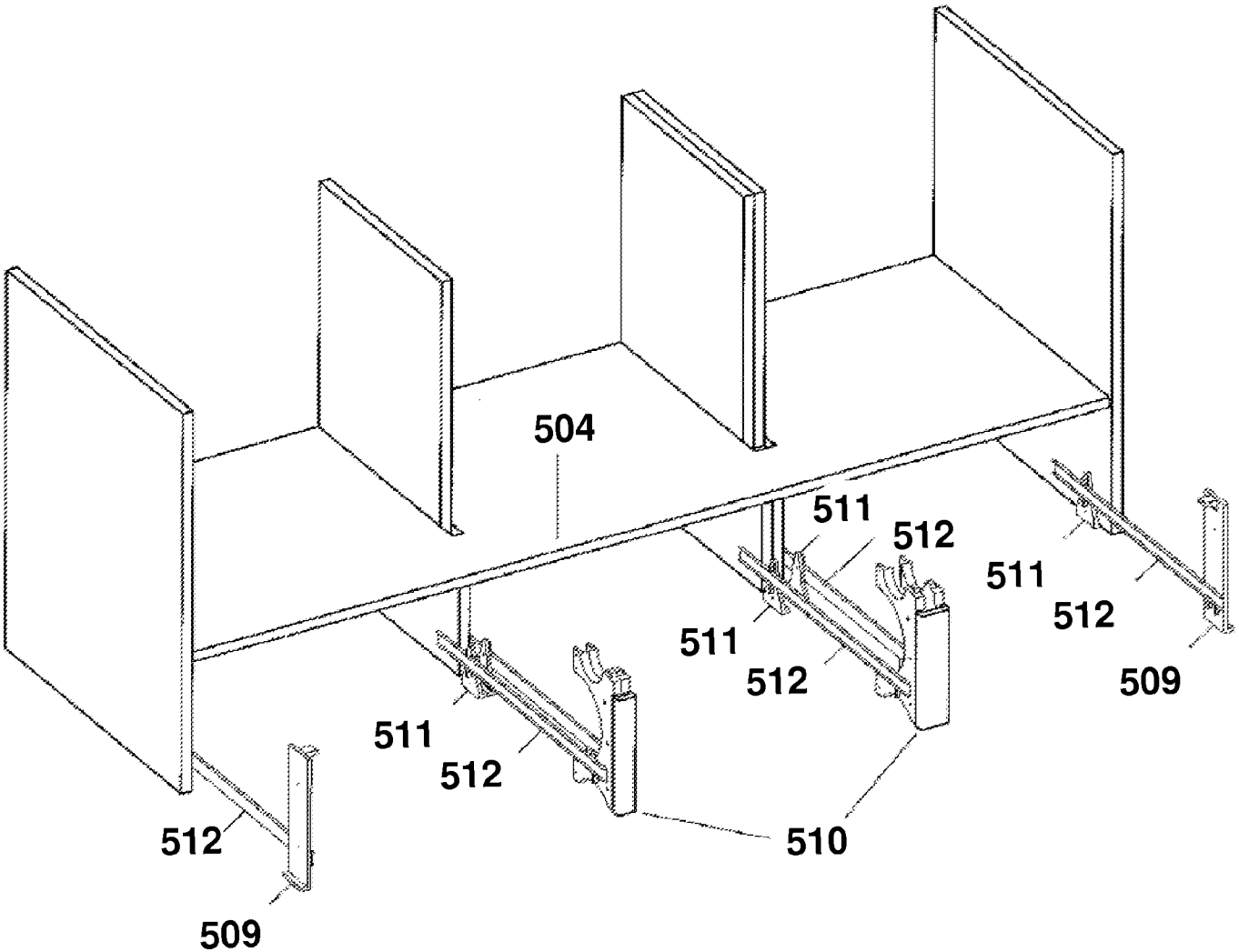
FIG. 5 is a perspective view of the bottom half of a closet illustrating the installation of the inner and outer braces described in the present invention.

As shown in FIG. 5, the braces are positioned on the closet in the following way: an outer brace (509) is attached to each side of the closet, facing inwards, and the two inner braces (510) are attached to the drawer dividers from both sides. These braces offer extra support to the sides and dividers of the closet, and transfer the weight of the upper compartment in the items within it to the floor. The rails (512) of the drawers are held by the braces (509, 510) at the front and by six (one for each side wall and two for each drawer divider) rail fittings (511) at the rear of the closet.

Figure 4:
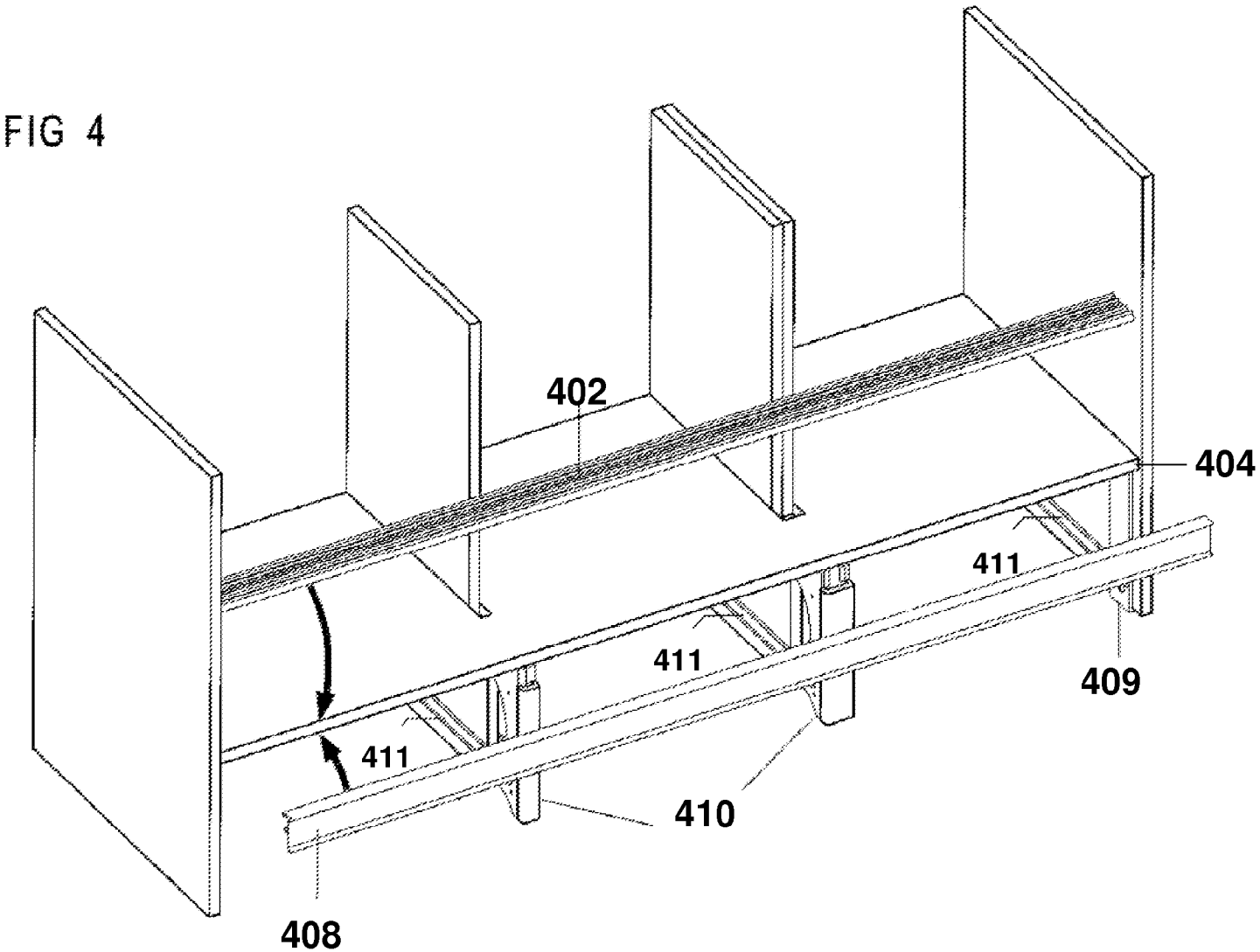
FIG. 4 is a perspective view of the bottom half of a closet equipped with a bracing system illustrating the positioning of the sliding door rail and metal profile described in the present invention.
Figure 8:
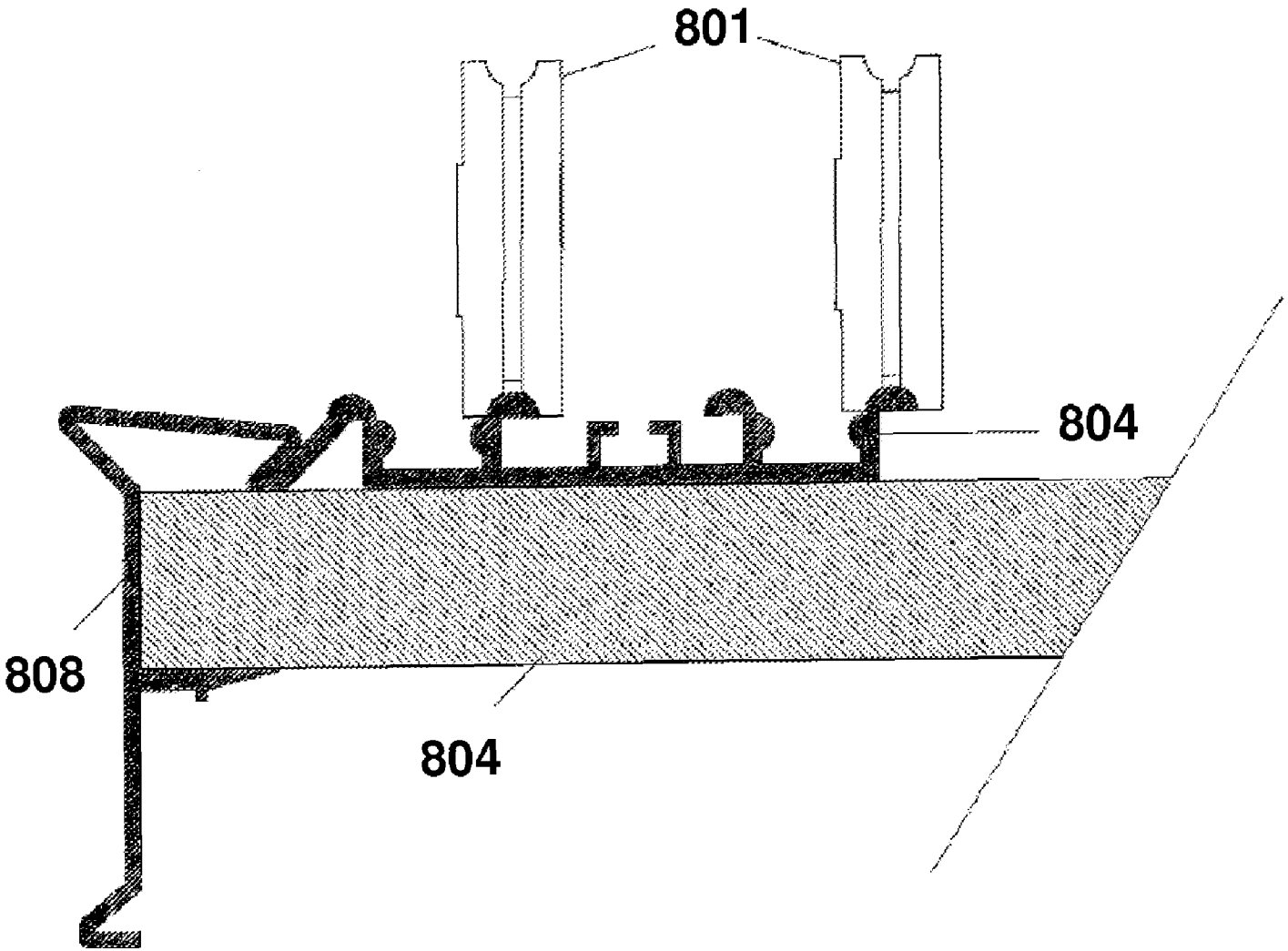
FIG. 8 is a cross-sectional side view of the lower closet shelf, metal profile, sliding door rail and sliding door constructed and operative in accordance with the present invention.

Referring now to FIG. 4, the metal profile (408) is designed to cover the front panel of the bottom shelf of the closet just above the row of drawers, perpendicular to the sliding door rail (402). FIG. 8 shows a cross-sectional side view of the profile (808), shelf (804), sliding door rail (802) and sliding door (801). The profile (808) may be attached to the front edge of the shelf (804) using pressure and makes contact with the sliding door rail (802). Referring again to FIG. 4, the profile (408) is a supporting member that rests on top of each of the inner braces (410). This contact between the door rail (402), the profile (408), and the braces (409) further transfers the upper weight to the floor.

Figure 6:
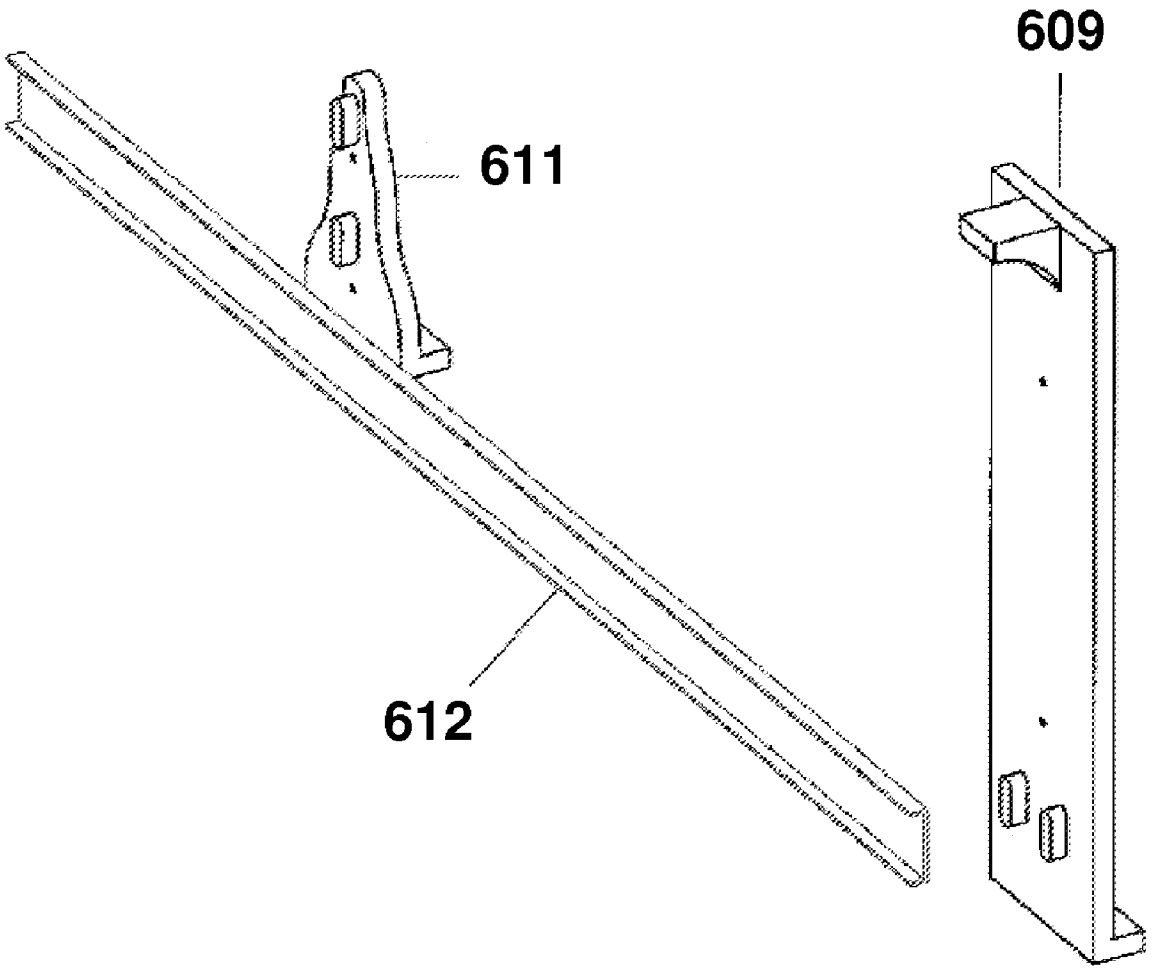
FIG. 6 illustrates the construction of an outer bracing unit consisting of a drawer rail, outer brace, and rail fitting as described in the present invention.

FIG. 6 shows the construction of a disassembled side wall unit, consisting of an outer brace (609), rail fitting (611), and drawer rail (612). The outer brace (609) is screwed into the front of the side wall, and the fitting (611) is screwed to the back. The drawer rail (612) is then attached screwed to both the brace (609) and the fitting (611).

Figure 7:
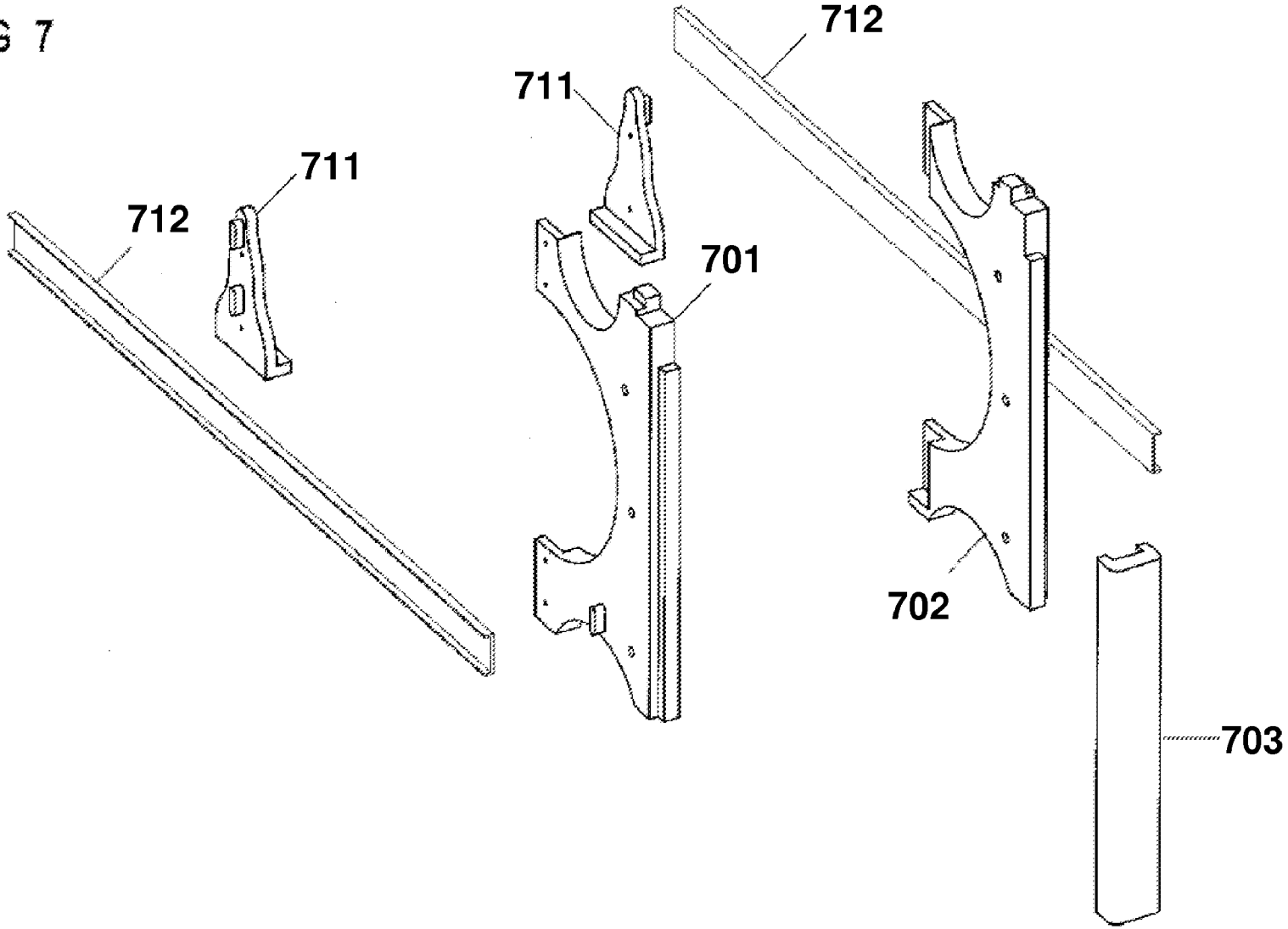
FIG. 7 illustrates the construction of an outer bracing unit consisting of two drawer rails, outer brace, and two rail fittings as described in the present invention.

FIG. 7 shows the construction of a disassembled drawer divider unit, consisting of an inner brace (710), two rail fittings (711), and two drawer rails (712). The inner brace is comprised of three parts: two symmetrically identical halves (701, 702), and a front panel (703). The two rail fittings (711) are screwed into the appropriate area in the back of the drawer divider on each side. The two halves (701, 702) of the inner brace (710) are positioned on the front edge of the divider on either side and screwed into place. The front panel (703) may then be snapped into place using pressure, serving the double purpose of offering extra support by holding the halves of the brace together, and providing an aesthetic finish. The drawer rails (712) are then attached to the brace (710) and rail fittings (711) with screws.

Once the bracing system is assembled and the drawers of the closet are in place, most of the components of the system are hidden from view. As shown in FIG. 1, the only parts in view are the front panels of metal profile and inner drawer braces, which may be finished to match any closet system. The bracing system provides stability and durability for any closet system containing a row of bottom drawers and a sliding door. It may be easily installed on any existing closet system of this type, or preinstalled on closets as they are manufactured.

While the above description contains many specifities, these should not be construed as limitations on the scope of the invention, but rather as exemplifications of the preferred embodiments. Those skilled in the art will envision other possible variations that are within its scope. Accordingly, the scope of the invention should be determined not by the embodiment illustrated, but by the appended claims and their legal equivalents.

What is claimed is:

1. A closet located on a floor comprising an upper compartment having at least one shelf, at least one sliding doors rail, sliding doors that slide on said at least one rail, at least one drawer each said drawer having a drawer divider unit and a supporting system said supporting system comprising:

a. at least two outer supporting braces attached to inner side walls of the closet wherein a lower part of each brace reaches down to the floor and an upper part to the shelf above the drawer;

b. at least one inner brace that is attached to the drawer divider; and c. a metal profile attached to a front edge of the shelf above the drawer, wherein said profile is in contact with the door rail, and a lower edge of the profile is in contact with the upper part of the supporting braces;

wherein the supporting parts of said closet enable transferring the weight of the sliding doors and the weight of the upper compartment from the drawers to the floor.

2. The system of claim 1 wherein said at least one inner brace comprises two symmetrically identical halves, each attaches to an inner wall of the drawer divider on oppositional sides.

3. The system of claim 2 further comprising a front panel offering extra support by holding the halves of the brace together, and providing an aesthetic finish.

4. The system of claim 1 wherein the supporting system is added to an existing closet.

5. The system of claim 1 wherein the supporting system is built-in into said closet.

6. A method for providing support to a closet located on a floor comprising an upper compartment, at least one sliding doors rail, sliding doors that slide on said at least one rail, at least one drawer each said drawer having a drawer divider unit and a supporting system, said method comprising:

a. attaching at least two outer supporting braces to inner side walls of the closet wherein a lower part of each brace reaches down to the floor and an upper part a shelf above the drawer;

b. attaching at least one inner brace to the drawer divider;

c. attaching a metal profile to a front edge of the shelf above the drawer, wherein said profile is in contact with the door rail, and a lower edge of the profile is in contact with the upper part of the supporting braces; and wherein the supporting parts of said closet enable transferring the weight of the sliding doors and the weight of the upper compartment from the drawers to the floor.

7. The method of claim 6 wherein the at least one inner brace is comprised of two symmetrically identical halves, each attached to an inner wall of the drawer divider on oppositional sides, further comprising a front panel offering extra support by holding the halves of the brace together, and providing an aesthetic finish.

8. The method of claim 6 wherein the supporting system is added to an existing closet.

9. The method of claim 6 wherein the supporting system is built-in into a closet.

* * * * *